United States Patent [19]

Ikegawa et al.

[11] Patent Number: 5,061,963

[45] Date of Patent: Oct. 29, 1991

[54] MONOCOMPONENT DEVELOPING DEVICE

[75] Inventors: Akihito Ikegawa; Yuji Enoguchi; Hiroshi Mizuno; Toshiya Natsuhara; Masashi Yamamoto, all of Osaka, Japan

[73] Assignee: Minolta Camera Kabushiki Kaisha, Osaka, Japan

[21] Appl. No.: 657,367

[22] Filed: Feb. 19, 1991

Related U.S. Application Data

[63] Continuation of Ser. No. 327,034, Mar. 22, 1989, abandoned.

[30] Foreign Application Priority Data

Mar. 23, 1988 [JP] Japan ..... 63-69096

[51] Int. Cl.[5] ..... G03G 15/06

[52] U.S. Cl. ..... 355/259; 118/651; 118/653; 355/245

[58] Field of Search ..... 355/245, 259, 256; 118/661, 645, 653, 651, 612, 257; 29/130, 132; 427/194

[56] References Cited

U.S. PATENT DOCUMENTS

| | | | |
|---|---|---|---|
| 4,100,884 | 7/1978 | Mochizuki et al. . | |
| 4,227,797 | 10/1980 | Tsunoi | 355/256 |
| 4,596,455 | 6/1986 | Kohyama et al. | 355/259 X |
| 4,760,422 | 7/1988 | Seimiya et al. . | |
| 4,791,882 | 12/1988 | Enoguchi et al. . | |
| 4,827,868 | 5/1989 | Tarumi et al. | 355/259 X |

FOREIGN PATENT DOCUMENTS

| | | | |
|---|---|---|---|
| 0011976 | 1/1983 | Japan | 355/289 |

*Primary Examiner*—A. T. Grimley
*Assistant Examiner*—Thu A. Dang
*Attorney, Agent, or Firm*—Burns, Doane, Swecker & Mathis

[57] ABSTRACT

The present invention discloses a developing device which includes a rotatably arranged photoreceptor, a rotatably disposed elastic roller confronting the photoreceptor, a cylindrically formed flexible member having a peripheral length longer than that of the elastic roller and loosely mounted thereover, and a positioning member to position the flexible member partly into contact with the photoreceptor, the positioning member including an elastic member to form a slack of the flexible member at a location confronting the photoreceptor for the flexible member to contact with the photoreceptor.

6 Claims, 2 Drawing Sheets

MONOCOMPONENT DEVELOPING DEVICE

This application is a continuation of application Ser. No. 07/327,034, filed Mar. 22, 1989, now abandoned.

BACKGROUND OF THE INVENTION

1. Field of the Invention

The present invention generally relates to a developing device for use in an electrophotographic copying machine, a printer or the like and more particularly, to a developing device which visualizes an electrostatic latent image formed on a photoreceptor by supplying monocomponent developer.

2. Description of the Related Art

Japanese Patent Laid-open Application No. 52-143831 discloses one such monocomponent developing device, in which a blade presses a supply of non-magnetic toner against the surface of an elastic developing roller so that a thin layer of charged toner may be formed on the peripheral surface of the developing roller. A toner image is then, formed by bringing this layer of charged toner into direct contact with the surface of the photoreceptor.

Alternatively, Japanese Patent Laid-open Application No. 61-176959 discloses another monocomponent developing device, in which the photoreceptor is pressed against the a developing roller. The developing roller of this device is a soft, foamed elastic member which, for example, sponge rubber, urethane rubber, or the like for the purpose of expanding the contacting (developing area) between the developing roller and the photoreceptor as well as improving the efficiency of the developing process.

Both of these methods require a blade to press the surface of the developing roller with enough pressure to form an even toner coating. Consequently, the developing roller needs to be relatively hard in order to resist the pressure of the blade. But on the other hand, to prevent damage to the photoreceptor or smearing of the image formed between the developing roller and the photoreceptor, the developing roller needs to softly contact the photoreceptor. These contradictory requirements for a hard and soft developing roller are one impetus behind the present invention. Another motivating factor is the reduced clarity of the image formed on the photoreceptor when the peripheral speed of the developing roller is different from that of the photoreceptor.

SUMMARY OF THE INVENTION

The main object of the present invention is to provide a monocomponent developing device which has a high developing efficiency. Other objectives for this invention include the capability for high speed developing and easy maintenance.

These goals for the present invention will be achieved by providing a developing device comprising a rotatably arranged photoreceptor, a rotatably disposed elastic roller confronting said photoreceptor, a cylindrically formed flexible member having a peripheral length longer than that of said elastic roller and loosely mounted thereover, a and means to position said flexible member into partial contact with the photoreceptor which includes an elastic member to form slack in the flexible member where the photoreceptor and the flexible member make contact.

These and other objectives, advantages and features of the invention will become apparent from the following description in conjunction with the accompanying drawings which illustrate specific embodiments of the invention.

BRIEF DESCRIPTION OF THE DRAWINGS

In the following description, like parts are designated by the same reference numbers throughout the several drawings.

DESCRIPTION OF THE PREFERRED EMBODIMENTS

The present invention will be described in reference to the drawings labelled FIG. 1 and FIG. 2.

Figure 1:
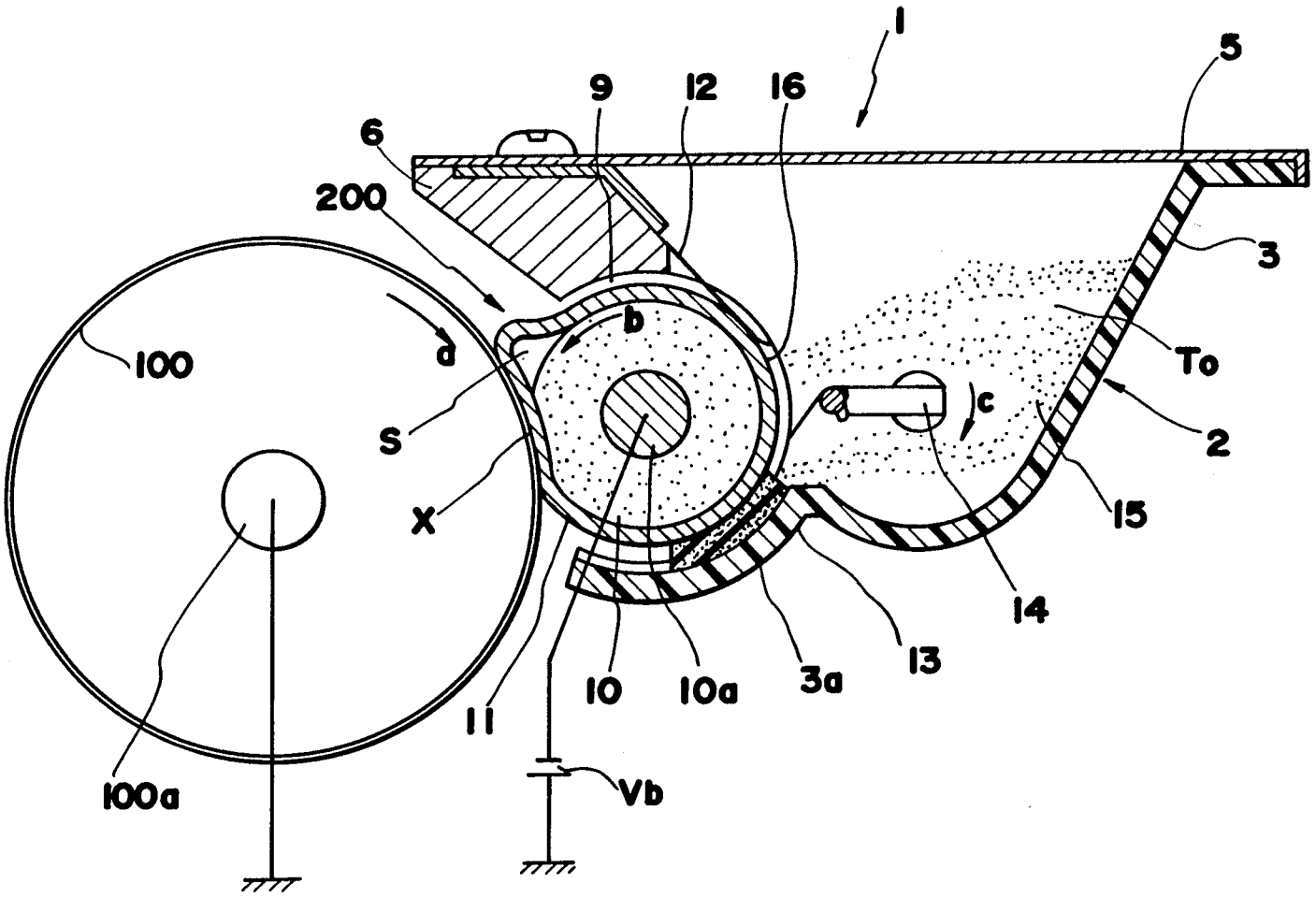
FIG. 1 is a side cross-sectional view of a monocomponent developing device according to the present invention.

FIG. 1 shows cross section of a developing device 1 according to the present invention. The developing device 1 adjoins a photoreceptor drum 100 which is rotatably driven in a direction as shown by an arrow (a).

In the developing device 1, a casing 2 consists of a frame 3 for covering the bottom and rear portions of the casing, side states 4 (see FIG. 2), a cover 5, and a support member 6 installed at one end of said cover 5 where the cover 5 confronts the photoreceptor drum 100.

An elastic roller 10 is formed over the external surface of a metallic roller 10*a* to which a developing bias voltage $V_b$ is applied Materials having electrical conductivity and elasticity are preferably used for forming the elastic roller 10. Examples of such materials are nitrile rubber, silicone rubber, stylene rubber, butadiene rubber or the like to each of which an electrically conductive member such as fine carbon or metallic particles is added.

A film member 11 is loosely mounted over the external surface of the elastic roller 10. The film member 11 has a peripheral length somewhat longer than the elastic roller so that a space S is formed between the elastic roller 10 and the film member 11. Materials used to form film member 11 include soft resins such as polycarbonate, nylon, fluoric resins and the like with added fine carbon or metallic particles; a metallic thin film of nickel, stainless steel, aluminum and the like; or a laminated film formed with similar resinous and metallic laminations.

A developing roller 200 is composed of the metallic roller 10*a*, the elastic roller 10 formed over the external surface of the metallic roller 10*a*, and the film member 11 loosely mounted over the external surface of the elastic roller 10.

Figure 2:
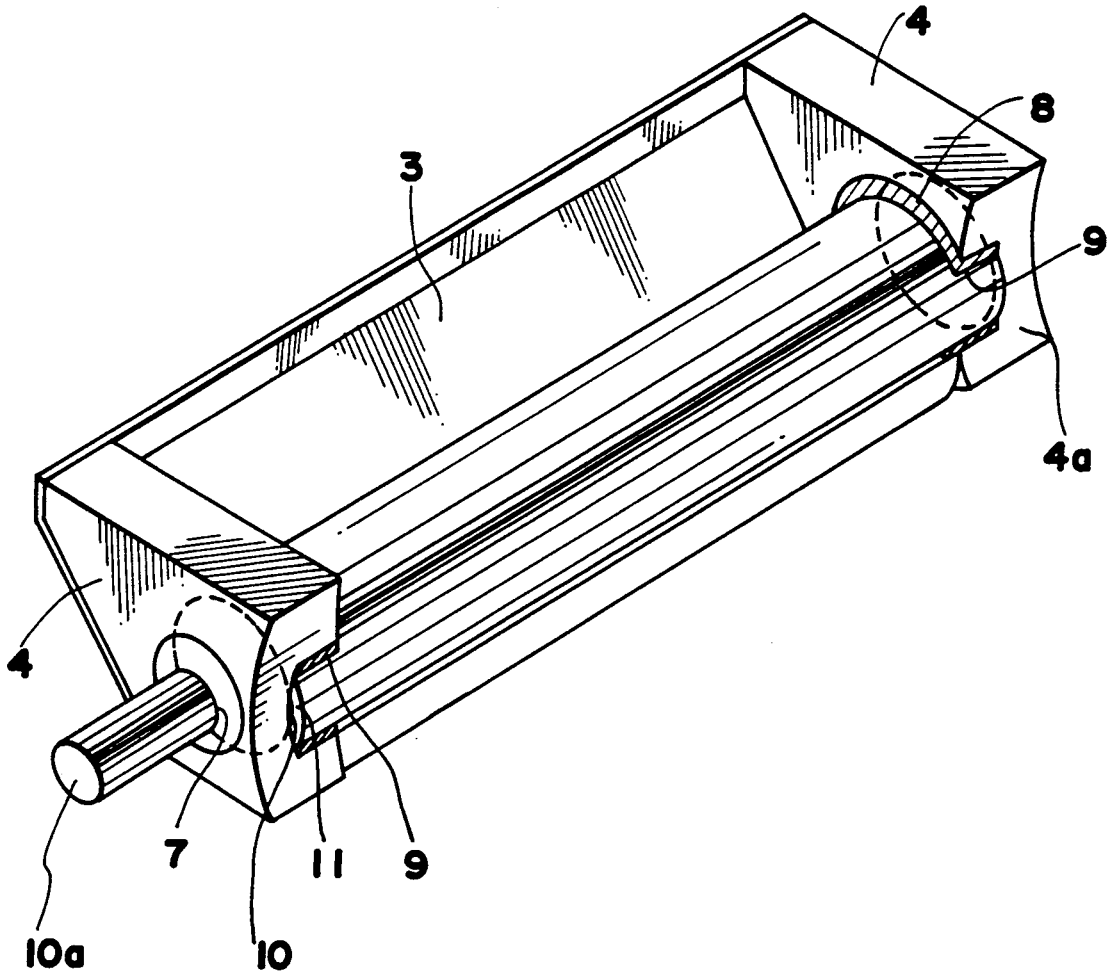
FIG. 2 is an isometric diagram illustrating how the elastic roller is supported.

The metallic roller 10*a* is rotatably supported on bearings 7 (only one bearing is shown) provided at the side plates 4 as shown in FIG. 2. The metallic roller 10*a* for supporting the elastic roller 10 passes through said bearings 7. The metallic roller 10*a* is connected to a driving source which is not shown. Both ends of the elastic roller 10, resting in housings provided at the side plates 4 of elastic pads 9, lie between the housing 8 and the film member 11 so that the film member 11 adheres to the external surface of the elastic roller 10. Materials used for forming the elastic pads 9 are polyacetals, phenolic resin, polyethylene, nylon, or fluoric resin. The surfaces where the elastic pads 9 make contact with film member 11 are covered with polyethylene, nylon, Teflon (trademark), or the like. The elastic pads 9 may also be formed entirely of the material used for the surface component of the elastic pads.

At fronts 4a of the side plates the housing 8 open to confront the photoreceptor. As shown in FIG. 1, the film member 11 is caused to adhere to the external surface of the elastic roller 10 except for a slack portion that is formed where the elastic roller 10 confronts the photoreceptor drum 100. The slack portion of the film member 11 gathers at the upstream side from between the film member 11 and the photoreceptor drum 100 meet with respect to the direction of the rotation of the elastic roller 10 so that a space S is formed between the film member 11 and the elastic roller 10. The slack portion covering this space S contacts with the surface of the photoreceptor drum 100.

The elastic pads 9, the elastic roller 10, the film member 11, and the photoreceptor drum 100 are selected to satisfy the relationship of $U_1 > U_2 + U_3$; where $U_1$ is the coefficient of the friction between the external surface of the elastic roller 10 and the internal surface of the film member 11 is, $U_2$ is the coefficient of friction between the external surface of the film member 11 and the elastic pad 9 and $U_3$ is the coefficient of friction between the external surface of the film member 11 and the photoreceptor drum 100 is.

When this relationship between $U_1$, $U_2$, and $U_3$ holds true and elastic roller 10 rotates in a direction as shown by arrow (b), the film member 11 rotates synchronously with the elastic roller 10 since there is no slip between the film member 11 and the elastic roller 10. The slack portion covering the space S is then pressed against the surface of the photoreceptor drum 100 in a developing region X by the elastic force of the elastic roller 10.

A regulating blade 12 is positioned where the support member 6 contacts with the casing 2. The leading end of the regulating blade 12 is provided with a flexible sheet such as Teflon (trademark), nylon or the like. This regulating blade 12 presses the elastic roller 10 through the film member 11. The regulating blade 12 is formed out of thin, springy, material such as SK steel, stainless steel, or phosphor bronze. The regulating blade may also be formed out of non-metallic elastic plate such as silicon rubber, urethane rubber, fluoric resin, nylon, or a laminated plate composed of any combination of metallic and non-metallic materials. Any laminated plate may be composed of materials which are remote from the toner in the triboelectric series.

Further, a toner leveling pad 13 is disposed at a location 3a where the frame 3 confronts the elastic roller 10 so as to contact with the external surface of the elastic roller 10 through the film member 11. The toner leveling pad 13 is formed out of a silicon rubber with an of elastic layer such as foamed urethane.

A toner storing compartment 15 is provided to hold a toner To in the casing 2. The toner storage compartment 15 has an agitator 14 which rotates in a direction as shown by an arrow (c) to move the toner toward the elastic roller 10 and prevent the toner from solidifying.

The operation of the developing device 1 will now be described.

When the elastic roller 10 and the agitator 14 are caused to rotate by driving means (not shown) in the directions indicated by the arrows (b) and (c), the toner To within the toner storing compartment 15 is forcibly moved in the direction shown by the arrow (c) by the stirring effect of agitator 14.

At the same time the film member 11 rotates in the direction as shown by the arrow (b) under the influence of frictional forces between the film member 11 and the elastic roller 10. The toner To accommodated within the toner storing compartment 15, is caused to adhere to the surface of the film member 11 by the action of electrostatic force so as to be transported in the direction as shown by the arrow (b). When the toner To on the surface of the film member 11 reaches position 16, it is pressed by the regulating blade 12 onto the surface of the elastic roller 10. The toner To is applied to the surface of film member 11 in a uniformly thin layer and given a positive charge from the frictional contact between the toner To and the regulating blade 11.

When the toner To held on the surface of film member 11 by electrostratic forces reaches a developing region X confronting the photoreceptor drum 100, the toner To is caused to adhere to an electrostatic latent, image formed on the surface of the photoreceptor drum 100. This creates a toner image according to a voltage difference between the surface of the photoreceptor drum 100 and a bias voltage applied to the elastic roller 10.

The slack portion of the film member 11 is brought into contact with the surface of the photoreceptor drum 100. Simultaneously, that slack portion is pressed against the surface of the photoreceptor drum 100 by the elastic force of the elastic roller 10 in the developing region X. Consequently, the film member 11 softly and uniformly contacts the photoreceptor drum over a suitably large area so that the latent image formed on the photoreceptor drum 100 may be turned into a uniform toner image.

Note that when the peripheral speed of the photoreceptor drum 100 differs from that of the film member 11, the toner image that is formed on the photoreceptor drum 100 can not be smeared by physical forces such as from rubbing or the like. In particular, where the peripheral speed of the film member 11 is set faster than that of the photoreceptor drum 100, the density of an image can be increased so that fogging can be effectively prevented in the area of the photoreceptor without any image.

The toner To having passed the developing region X is continually transported, together with the film member 11, in the direction as shown by the arrow (b). When the toner To passes between the toner leveling pad 13 and the film member 11, the image pattern from which the toner To has already been consumed in developing region X is erased so that the new uniform layer of the toner may be attached to the film member 11.

After the image pattern has been erased, the toner To is again supplied to the surface of the film member 11 by the rotation of agitator 14. After a thin layer of charged toner is uniformly formed again on the surface of the film member 11 by the pressure of regulating blade 12, the process is repeated.

In addition, although the embodiment of the present invention shows the developing device wherein the slack portion of the film member is positioned on the up-rotation side of the developing region, it can also be operated with the slack portion of the film member positioned at the down-rotation side of the developing region.

As clearly described so far, in the developing device according to the present invention, the film member lightly contacts the surface of the photoreceptor drum so that the surface of the photoreceptor drum will not become damaged or fused with toner. In this way, the photoreceptor drum has a longer operating life and requires less maintenance. Moreover, the developing device according to the present invention requires less torque from the drive motor so that less expensive motors may be used to produce a lower cost developing device.

Furthermore the film member contacts with the photoreceptor drum over a suitably large area in order to enlarge the developing region. This allows the development to be carried out at a high speed since the toner is more consistently supplied to the surface of the photoreceptor drum. As a result, a uniform developing image can be obtained with this device.

The maintenance of the developing device is also less complicated because only the film member needs to be replaced when the developing roller becomes damaged by abrasion, toner fusion or the like. Without the film member such damage could create the need to replace the entire developing roller.

Although the present invention has been fully described with examples referring to the accompanying drawings, it is to be noted that various changes and modifications will be apparent to those skilled in the art. Therefore, unless such changes and modifications depart from the scope of the present invention, they should be construed as being included in this invention.

What is claimed is:

1. A developing device disposed adjacently to a rotatably arranged photoreceptor, which comprises:

a rotatably disposed elastic roller confronting said photoreceptor;

a cylindrically formed film member having a peripheral length longer than that of said elastic roller and loosely mounted thereover, said film member being pressed toward the photoreceptor at a pressing portion by said elastic roller so as to contact the photoreceptor; and positioning means to position said film member partly into contact with the photoreceptor, said positioning means including an elastic member to form a slack portion in the film member at a location confronting the photoreceptor for the film member to contact the photoreceptor, whereby the film member is in contact with the photoreceptor at said pressing portion as well as at said slack portion.

2. A developing device as claimed in claim 1 wherein said elastic roller presses said slack of the film member against the surface of the photoreceptor in a developing region.

3. A developing device as claimed in claim 1 wherein said elastic member is in contact with the film member which in turn is in contact with the photoreceptor.

4. A developing device as claimed in claim 3 wherein said elastic member is in contact with the film member for at least a portion upstream of said developing region with respect to a direction of the rotation of said elastic roller.

5. A developing device as claimed in claim 3 wherein said elastic member is in contact with the film member for at least a portion downstream of said developing region with respect to a direction of the rotation of said elastic roller.

6. In a developing device comprising a photoreceptor on which an electrostatic latent image is formed, a method comprising the steps of:

providing an elastic roller, said elastic roller being rotatable and confronting said photoreceptor;

loosely mounting a flexible member over the elastic roller;

pressing a part of the flexible member at the side confronting the photoreceptor of the elastic roller by means of the elastic roller; and forming a slack portion in the flexible member at the side confronting the photoreceptor of the elastic roller and, contacting the photoreceptor with said slack portion.

* * * * *